United States Patent [19]

Tasaki et al.

[11] Patent Number: 4,953,213

[45] Date of Patent: Aug. 28, 1990

[54] SURROUND MODE STEREOPHONIC REPRODUCING EQUIPMENT

[75] Inventors: Akira Tasaki; Tomohiro Takegawa, both of Tokyo, Japan

[73] Assignee: Pioneer Electronic Corporation, Tokyo, Japan

[21] Appl. No.: 412,751

[22] Filed: Sep. 26, 1989

[30] Foreign Application Priority Data

Jan. 24, 1989 [JP] Japan ..... 1-5991[U]

[51] Int. Cl.[5] ..... H04R 5/02

[52] U.S. Cl. ..... 381/24; 381/22; 381/27

[58] Field of Search ..... 381/1, 18, 24, 27, 22

[56] References Cited

U.S. PATENT DOCUMENTS

| | | | |
|---|---|---|---|
| 3,697,692 | 10/1972 | Hafler . | |
| 4,115,666 | 9/1978 | Ogura . | |
| 4,410,761 | 10/1983 | Schickedanz | 381/24 |
| 4,696,036 | 9/1987 | Julstrom . | |
| 4,792,974 | 12/1988 | Chace | 381/1 |
| 4,807,217 | 2/1989 | Ide | 381/22 |
| 4,862,502 | 8/1989 | Griesinger | 381/22 |

OTHER PUBLICATIONS

Rundum-Sound fur zu Hause, Live-Atomsphare von Der Videokassette, *Funkschau Videosoftware* Funkschau, 17,1986, 88-92.

*IEEE Spectrum,* Untangling the 'Quad' Confusion, by Ronald K. Jurgen, Jul. 1972, s, 55-62.

*Primary Examiner*—Forester W. Isen

*Attorney, Agent, or Firm*—Sughrue, Mion, Zinn, Macpeak & Seas

[57] ABSTRACT

The invention provides surround mode stereophonic reproducing equipment for using the Dolby surround mode and another surround mode other than the Dolby mode by means of selectively switching between them. The equipment is provided with two front power amplifiers for driving front speakers on the right and left, and two rear power amplifiers for driving the rear speakers. The rear speakers are driven jointly by one of the rear power amplifiers while the center speaker is driven by the other power amplifier when using the Dolby surround mode, and the rear speakers are respectively driven by the two rear power amplifiers when using a surround mode other than the Dolby surround mode.

3 Claims, 1 Drawing Sheet

SURROUND MODE STEREOPHONIC REPRODUCING EQUIPMENT

FIELD OF THE INVENTION

The present invention relates to surround mode stereophonic reproducing equipment which can be used in the Dolby surround mode or in a surround mode other than the Dolby surround mode by selectively switching between them.

BACKGROUND OF THE INVENTION

Live sound heard, for example, in a concert hall, theater, sport stadium or the like contains not only the direct sound but also considerable reverberations and the indirect sounds which are reflected from surrounding walls, ceilings and the like. In recent years, a stereophonic reproducing mode, the so-called surround mode has been used to reproduce sound which realistically approximates such live sound to the fullest extent possible.

A surround mode is a stereophonic reproducing mode which produces sound field components, such as rear components and center components in addition to two-channel stereophonic reproducing signals on both right and left sides. The sound field components sound field with surrounding sensation is created by actuating speakers with these signals. Several forms have been proposed by various manufactures.

FIG. 2 shows the construction of stereophonic reproducing equipment in the Dolby mode which is a widely used surround mode.

The Dolby surround mode consists of three front channels (however, when only a small space is provided as a viewing area, as in the case of an average household, only two front channels are sufficient) and one rear channel (monaural). Front speakers $24_L$ and $24_R$ provide two channels on both sides (stereophonic) and a center speaker $26_C$ is provided at the center, in the front. In addition, rear speakers $25_L$ and $25_R$ are provided with one channel each (monaural) on both sides in the rear.

A surround processor circuit 21 internally generates (by means of its internal logic) and outputs a total of five outputs consisting of outputs $F_L$ and $F_R$ (stereophonic) on both sides for the front, outputs $R_L$ and $R_R$ (monaural) on both sides for the rear, and a center output C, based on the two channels of stereophonic signals L and R that are input.

The outputs $F_L$ and $F_R$ on both sides for the front are the input two-channel stereophonically reproduced signals L and R themselves. The outputs $R_L$ and $R_R$ on both sides for the rear are monaural signals obtained by giving predetermined delays to the subtracted signal (L−R) of the stereophonically reproduced signals R and L. The center output C is the summed signal (L+R) of the stereophonically reproduced signals L and R.

The five output signals in the above are amplified respectively by power amplifiers $22_1$ to $22_5$ provided for the respective output circuits. The five output signals are then sent via a speaker terminal 23 to the respective speakers $24_L$, $24_R$, $25_L$, $25_R$ and $26_C$ to perform a prescribed Dolby surround reproduction by actuating the respective speakers.

As described above, the Dolby surround mode actuates a total of five speakers arranged on both ends in the front, on both ends in the rear, and at front center by means of five power amplifiers.

Various modes other than the Dolby mode have been proposed as surround modes. Namely, the theater mode, the stadium mode, and the simulated mode are known in the art. In the theater mode, use is made of delayed (L−R) signals for both ends in the rear in addition to the L and R signals for both ends in the front. In the stadium mode, a delayed (L−R) signal for rear left and a (L−R) signal for rear right in addition to the L and R signals for both ends in the front are used. In the simulated mode, delayed (L+R) signals for both ends in the rear, in addition to the L and R signals for both ends in the front, are used. All of these modes make use of four power amplifiers to actuate a total of four speakers for both ends in the front as well as in the rear.

It is desirable to construct the equipment so that the listener can reproduce the sound by selecting a surround mode which is best suited to the sound source that is to be reproduced. This can be accomplished by incorporating a plurality of surround modes in surround mode stereophonic reproducing equipment.

In incorporating a plurality of surround modes in one piece of equipment, the most standard method would be to incorporate the Dolby surround mode with specifications that are in wide use as the standard mode, and then add another surround mode to it. However, as is clear from the above, the Dolby surround mode requires five power amplifiers, whereas surround modes other than the Dolby surround mode can operate with only four power amplifiers. This creates an obstacle for providing inexpensive stereophonic reproducing equipment which incorporates a plurality of surround modes.

SUMMARY OF THE INVENTION

The above circumstances motivated the present invention, and it is, therefore, the object of the present invention to provide surround mode stereophonic reproducing equipment which enables reproduction of the Dolby surround mode and a surround mode other than Dolby by selectively switching between them and by using only four power amplifiers.

In order to achieve the above object, in surround mode stereophonic reproducing equipment for using the Dolby surround mode and another surround mode other than the Dolby surround mode by means of selectively switching between them, two front power amplifiers are provided for driving the front speakers on both ends and two rear power amplifiers are provided for driving the rear speakers. When using the Dolby surround mode, the rear speakers on both ends are driven jointly by one of the two rear power amplifiers while the center speaker is driven by the other power amplifier. In the case of a surround mode other than the Dolby surround mode, the rear speakers on both ends in the rear are respectively driven independently by the two rear power amplifiers.

In examining the driving signals for each speaker in the Dolby surround mode, it will be seen that the driving signals $R_L$ and $R_R$ to be applied to rear speakers on both ends are delayed signals of the same monaural (L−R) signal. Accordingly, by amplifying the delayed (L−R) signals for the rear with one power amplifier, and by jointly driving the rear speakers on both ends, it becomes possible to reduce the number of power amplifiers required by the Dolby surround mode by one. As a result, the number of power amplifiers for the Dolby surround mode is reduced to four which is equal to the required number of power amplifiers for a surround mode other than the Dolby surround mode.

In other words, when using the Dolby surround mode, the rear speakers on both ends are jointly driven with one of the two rear power amplifiers, and the center speaker is driven with the other amplifier.

On the other hand, when using a surround mode other than the Dolby surround mode, the rear speakers on both ends are driven independently with the two rear power amplifiers. Consequently, a total of four power amplifiers, two for the front and two for the rear, will suffice for both of the Dolby surround mode and other surround modes.

DETAILED DESCRIPTION OF THE INVENTION

Figure 1:
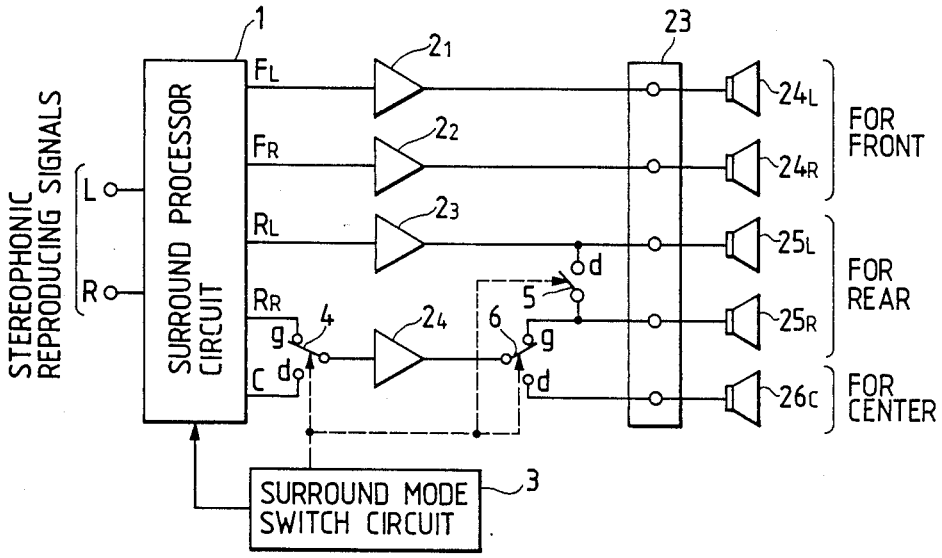
FIG. 1 is a block diagram for an embodiment of surround mode stereophonic reproducing equipment in accordance with the present invention.

Referring to the drawings, an embodiment of the present invention will now be described.

Figure 2:
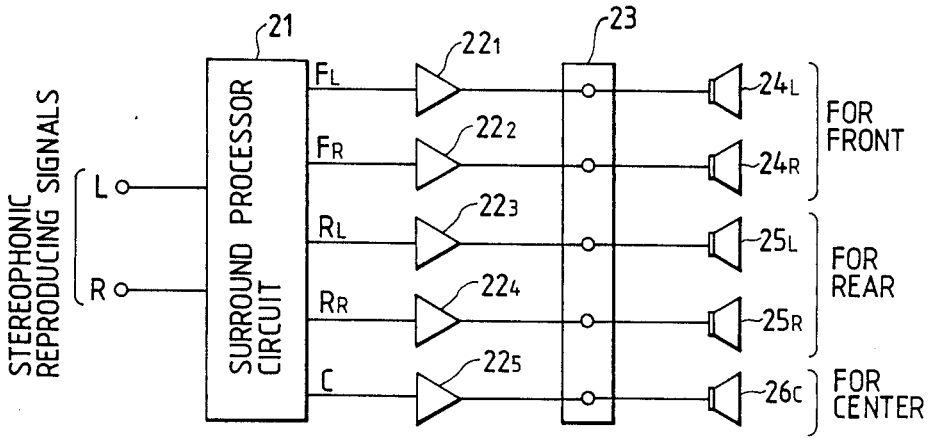
FIG. 2 PRIOR ART
Fig. 2 is a block diagram for conventional surround mode stereophonic reproducing equipment incorporating the Dolby surround mode.

FIG. 1 shows an embodiment of surround mode stereophonic reproducing equipment in accordance with the present invention. In the drawing, components identical to those in FIG. 2 are assigned identical symbols.

In Fig. a surround processor circuit 1 incorporates a plurality of surround modes. Specifically, a Dolby surround output and another surround output other than the Dolby output can be carried out by selectively switching between them. When using the Dolby surround mode, outputs $F_L$ and $F_R$ are generated on both ends in the front, and outputs $R_L$ and $R_R$ are generated on both ends in the rear, and a center output C is generated. When using a surround mode other than the Dolby surround mode, the center output C becomes nonexistent, and only outputs $F_L$ and $F_R$ for the front, and outputs $R_L$ and $R_R$ for the rear are output.

Reference numerals $2_1$ and $2_2$ are front power amplifiers for exclusively driving the speakers on both ends $24_L$ and $24_R$, respectively. Reference numerals $2_3$ and $2_4$ are rear power amplifiers for driving rear speakers $25_L$ and $25_R$ or a center speaker $26_c$, depending upon the surround mode selected as will be described later. Reference numeral 3 is a surround mode switching circuit for switching the surround mode of the surround processor circuit 1 and for setting switches 4–6 to predetermined mode terminal positions interlocked with the switching operation. The switches 4–6 are connected to the Dolby mode terminals d when the Dolby surround mode is selected, and are connected to the general purpose mode terminals g when a surround mode other than the Dolby surround mode is selected. FIG. 1 illustrates the condition in which the switches 4–6 are switched to the general purpose terminal g.

Next, the operation of the above-mentioned circuit will be described.

First, when the equipment is set to the Dolby surround mode by operating the surround mode switching circuit 3, the surround processor circuit is switched to the Dolby surround mode, and at the same time the switches 4–6 are changed over to the Dolby surround mode terminal d.

When signals for the Dolby surround mode are output from the surround processor circuit 1, the output $F_L$ (=L signal) on the left side and the output $F_R$(=R signal) on the right side for the front are amplified by the front power amplifiers $2_1$ and $2_2$, respectively, to actuate the corresponding front speakers $24_L$ and $24_R$ on both ends.

The left output $R_L$ for the rear is amplified by the rear power amplifier $2_3$, and actuates the left rear speaker $25_L$. At the same time, it also actuates the rear speaker $25_R$ via the Dolby mode terminal d of switch 5. In this case, the left output $R_L$ and the right output $R_R$ for the rear are delayed signals of the same monaural delayed (L−R) signal, so that actuation of the right side rear speaker $25_R$ with the left output $R_L$ will not produce a problem.

Moreover, the center output C is amplified by the rear power amplifier $2_4$ via the Dolby mode terminal d, and actuates the center speaker $26_C$ via the Dolby mode terminal d of the switch 6.

When the equipment is set to a surround mode other than the Dolby surround mode, such as the stadium mode, by operating the surround mode switching circuit 3, the surround processor circuit 1 is switched to the stadium surround mode, and the switches 4–6 are changed over also to the general purpose mode terminal g.

When signals for the stadium surround mode are output from the surround processor circuit 1, the left output $F_L$ (=L signal) and the right output $F_R$ (=R signal) for the front are amplified by the front power amplifiers $2_1$ and $2_2$, respectively, similar to the case of the Dolby surround mode, and actuate the corresponding front speakers $24_L$ and $24_R$ on both ends.

Further, the left output $R_L$ for the rear, that is, a delayed (L−R) signal, is amplified by the rear power amplifier $2_3$, and actuates the left rear speaker $25_L$.

On the other hand, the right output $R_R$, that is, another (L−R) signal, is sent via the general purpose terminal g of the switch 4 to the rear power amplifier $2_4$ to be amplified, and actuates the right rear speaker $25_R$ via the general purpose mode terminal g of the switch 6. In this case, the switch 5 is left opened so that no leakage occurs from the right output $R_R$ for the rear to the left rear speaker $25_L$. Further, when a surround mode other than the Dolby surround mode is selected, the center output C is not output.

As is clear from the above, in accordance with the present invention, it is possible to selectively reproduce the Dolby surround mode and a surround mode other than the Dolby mode by the use of four power amplifiers. As a result, an excellent effect can be realized by providing inexpensive stereophonic reproducing equipment incorporating the Dolby surround mode and another surround mode other than the Dolby surround mode.

What is claimed is:

1. In surround mode stereophonic reproducing equipment which can be used in the Dolby surround mode and another surround mode other than the Dolby surround mode, surround mode stereophonic reproducing equipment comprising:

two front power amplifiers for driving right and left front speakers, and two rear power amplifiers for driving right and left rear speakers, wherein said right and left rear speakers are driven jointly with one of said two rear power amplifiers and a center speaker is driven with the other rear power amplifier when the Dolby surround mode is selected, and said right and left rear speakers are driven independently of each other with said two rear power amplifiers when a surround mode other than said Dolby surround mode is selected.

2. Surround mode stereophonic reproducing equipment as claimed in claim 1, further comprising a surround mode switching circuit for selectively switching between said Dolby surround mode and said surround mode other than said Dolby surround mode.

3. In a surround mode stereophonic reproducing system of the type having a surround processor circuit for providing electrical signals representing selected stereo and monaural audio to a plurality of amplifiers for driving a plurality of front and rear speakers to produce a surround mode stereophonic sound, the improvement comprising:

switching means for selectively connecting first and second of said plurality of amplifiers in a configuration for achieving a Dolby surround mode and in a configuration for achieving a non-Dolby surround mode, said switching means comprising a first switch selectively connecting said first amplifier to left and right rear speakers of said plural speakers during said Dolby surround mode and connecting said first amplifier to one of said left and right rear speakers during said non-Dolby surround mode, and a second switch selectively connecting said second amplifier to said other of said left and right speakers during said non-Dolby surround mode and connecting said second amplifier to a central speaker of said plurality of speakers during said Dolby surround mode.

* * * * *